US005090055A

United States Patent [19]

McElroy

[11] Patent Number: 5,090,055

[45] Date of Patent: Feb. 25, 1992

[54] AIR CUSHION KNEELING PAD

[76] Inventor: Philip J. R. McElroy, 107 Compton Crescent, London, Ontario, Canada, N6C 4E9

[21] Appl. No.: 599,569

[22] Filed: Oct. 18, 1990

[30] Foreign Application Priority Data

Oct. 31, 1989 [CA] Canada ..... 2001893

[51] Int. Cl.[5] ..... A41D 13/06

[52] U.S. Cl. ..... 2/24; 2/2

[58] Field of Search ..... 2/22, 24, 2, 16, 267, 2/23, 62; 128/165, 80 C; 297/423, 426, 438, 439

[56] References Cited

U.S. PATENT DOCUMENTS

| | | | |
|---|---|---|---|
| 1,436,537 | 11/1922 | Rylander | 2/24 |
| 1,690,405 | 11/1928 | Du Rocher | 2/24 |
| 2,093,888 | 9/1937 | Holtje | 2/24 |
| 2,124,158 | 7/1938 | Turner | 2/24 |
| 2,195,817 | 4/1940 | Johnson | 2/24 |
| 2,338,424 | 1/1944 | Giardini | 2/24 |
| 2,363,058 | 11/1944 | Gill | 2/24 |
| 2,368,433 | 1/1945 | Terry | 2/24 |
| 2,572,360 | 10/1951 | Logan | 2/24 |
| 2,652,565 | 10/1953 | MacLellan et al. | 2/24 |
| 3,168,746 | 2/1965 | Smith | 2/24 |
| 3,256,879 | 6/1966 | Hipps | 2/2 |
| 3,908,198 | 9/1975 | Brock | 2/24 |
| 3,965,486 | 6/1976 | Lightbody | 2/24 |
| 4,361,912 | 12/1982 | Arthur | 2/22 |
| 4,627,108 | 12/1986 | Järvinen | 2/24 |
| 4,723,322 | 2/1988 | Shelby | 2/24 |
| 4,876,745 | 10/1989 | Richards | 2/24 |

FOREIGN PATENT DOCUMENTS

| | | | |
|---|---|---|---|
| 515449 | 11/1952 | Belgium | 2/24 |
| 197689 | 3/1920 | Canada | 2/24 |
| 334622 | 8/1933 | Canada | 2/24 |
| 497128 | 10/1953 | Canada | 2/24 |
| 553619 | 8/1930 | Fed. Rep. of Germany | 2/24 |
| 598556 | 10/1931 | Fed. Rep. of Germany | 2/24 |
| 337579 | 8/1956 | Fed. Rep. of Germany | 2/24 |
| 1129430 | 5/1962 | Fed. Rep. of Germany | 2/24 |
| 1031804 | 6/1953 | France | 2/24 |

*Primary Examiner*—Werner H. Schroeder
*Assistant Examiner*—Amy Brooke Vanatta
*Attorney, Agent, or Firm*—McFadden, Fincham, Marcus & Anissimoff

[57] ABSTRACT

A unique protective knee pad is disclosed which is comprised of one-piece molded resilient polyurethane foam. The pad has a special U-shaped sole with a transverse bar through the middle portion and a transverse bar at the rear. Two cavities are created by the transverse bars which are adapted to entrap air when the wearer is in the operative kneeling position thereby cushioning the delicate parts of the patella and upper shin, by preventing the outwardly extending portion of the knee from coming into contact with the ground.

2 Claims, 2 Drawing Sheets

AIR CUSHION KNEELING PAD

FIELD OF THE INVENTION

This invention relates to protective devices and, in particular, to knee pads.

Protective devices for the knees and shins of the human body have been known for many years. The patella or kneecap and the upper shin area are particularly vulnerable to damage. Knee pads of varying types have been devised for use in sports, domestic housework and for industrial applications. By far the most important applications are those for industrial use where workmen or technicians are required to spend a great deal of time on their knees in particularly rough areas such as on roofs or in boilers or other places where it is necessary to kneel constantly.

BACKGROUND OF THE INVENTION

One of the greatest sources of injury occurs when a workman falls to his knees and the impact of the fall is transmitted directly to the protruding patella. Even with protective gear, the patella can be damaged through this type of fall.

Numerous attempts have been made to cushion such a fall, all of which have been less than satisfactory. For instance, pneumatic type air bladders or cushions are blown up and inserted within a protective device. These are particularly bulky, however, and are often damaged by sharp objects. Such a device is disclosed in U.S. Pat. No. 3,965,486 (Lightbody) which has an inflatable flexible body portion divided into first and second chambers and uses a multiplicity of flexible-spaced hollow fingers which are inflatable. Similarly, U.S. Pat. No. 2,368,433 (Terry) also discloses and claims a pneumatic removable cushioning air bladder which when in use is placed into a canvas pocket strapped to the leg.

All of these devices are somewhat cumbersome and are not particularly adapted for protection of the patella and upper shin.

It is therefore an object of this invention to provide a simple, inexpensive, lightweight protective knee pad.

It is a further object of this invention to provide a knee pad which is equipped with air cushioning areas which are not of the pneumatic or bladder type.

SUMMARY OF THE INVENTION

Therefore this invention seeks to provide a knee protector pad adapted for use in the industrial workplace comprising a one-piece resilient, flexible polyurethane foam pad and an adjustable strap which is adapted to encircle the calf and thereby fixedly secure the pad to the wearer's leg;

said pad including a concave upper portion with a rounded front end and an open, squared rear end;

said upper portion is adapted to receive the knee and upper portion of the shin;

said pad further comprising a lower U-shaped sole with a rounded front and a squared back;

said sole including an integrally molded transverse bar; said bar defining a front semi-circular cavity and a rear rectangular cavity;

said front cavity being located immediately beneath the patella of the wearer when the pad is in an operating position and said transverse bar supporting a portion of the shin immediately below said patella;

whereby said cavities are adapted to entrap air when the wearer is in the kneeling position thereby providing a cushioning effect.

The device of the present invention consists of a one piece molded resilient flexible polyurethane foam. It has an upper concave portion which is adapted to receive the knee cap and upper front shin portion of the leg. The front is rounded to correctly fit the cap. The rear part of the upper concave portion is open so that the lower leg extends therefrom. The upper concave portion is raised so that no other portion of the leg comes in contact with the ground other than the foot.

The lower portion consists of a U-shaped sole similar in design to a horseshoe but having a transverse bar across the middle and an additional transverse bar forming the rear of the sole. The transverse bar defines two cavities within the sole, a front forward semi-circular cavity and a rear rectangular cavity. A strap enters the rear cavity through the one side of the sole and exits the opposite side of the rear cavity through other side of the sole, and thereafter encircles the upper concave portion in order that it can be fastened around the calf of the wearer.

The particular design of the cavities within the flat U-shaped sole are used to entrap air when the wearer is in the kneeling position. The weight of the wearer is transmitted to the U-shaped sole which is located below the circumference of the knee. Therefore only the less delicate outer extremities of the knee region are in direct contact with the ground by means of the sole and middle transverse bar. The front cavity is located directly beneath the patella of the wearer which protrudes slightly from the leg. The transverse bar is adapted to lie immediately beneath that portion of the upper shin which lies adjacent the patella. The rear cavity protects the remainder of the upper shin.

Because of the unique air entrapping cavities, the wearer may fall several feet landing directly upon the knee in the kneeling position without doing any harm to the sensitive areas of the upper shin and the patella.

The strap is positioned such that when it is around the calf of the wearer it does not cause undue wear in the fold of the wearer's leg between the upper and lower leg. This is particularly important when the pad is used for long periods of time.

BRIEF DESCRIPTION OF THE DRAWINGS

The invention will be more fully described in conjunction with the following drawings wherein.

DETAILED DESCRIPTION OF THE INVENTION

Figure 1:
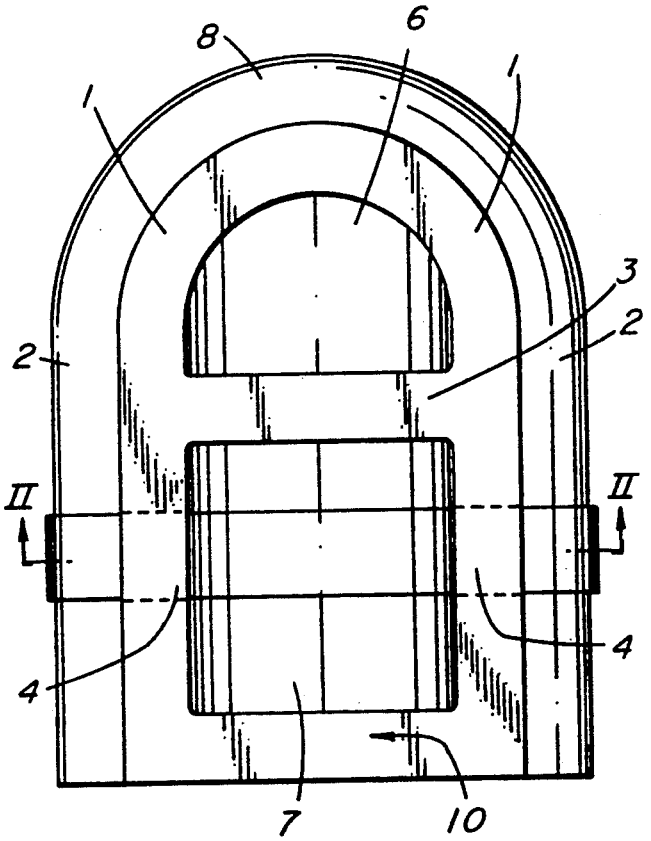
FIG. 1 is a bottom view of the knee pad.
Figure 3:
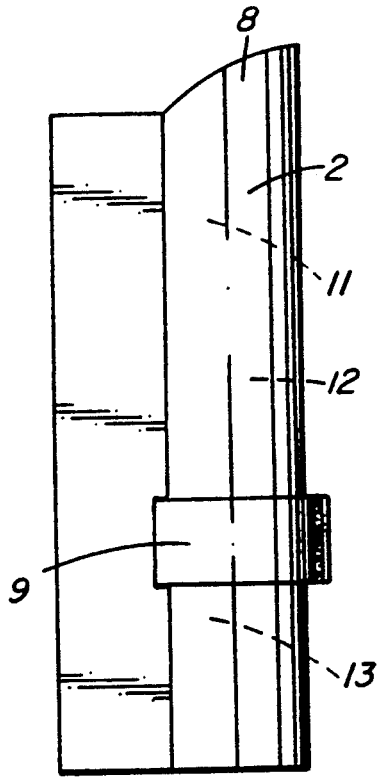
FIG. 3 is a transverse cross-section of the knee pad.

In FIG. 1, the knee pad is shown with a sole (1). The sole is U-shaped, having a rounded front and straight sides. A transverse bar (3) connects the two sides of the sole (1) thereby defining a front semi-circular cavity (6) and a rear rectangular cavity (7). Another transverse bar (10) connects the two sides of the sole (1) at the rear portion of the knee pad. Slits (4) are cut through the two sides of the sole to allow the strap to traverse the rear rectangular cavity (7). The upper portion of the knee pad comprises upper walls (2) which extend upwardly and outwardly from the sole (1). There is no rear upper wall as the leg must extend outwardly and rearwardly from the knee pad. The front portion of upper wall (2) shown as (8) is rounded.

When the knee pad which is the subject of the invention is on a flat surface, air is entrapped in front semi-circular cavity (6) and rear rectangular cavity (7) thereby providing a cushion when weight is placed on the pad.

Figure 2:
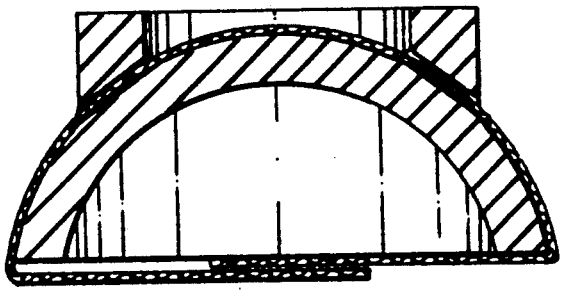
FIG. 2 is a longitudinal cross-section of the knee pad.

The upper walls (2) are formed with a concave inner surface. This is adapted to receive the patella and the upper portion of the shin of the leg. The patella which protrudes slightly from the leg is adapted to fit in or near portion (11). One notes that this is directly above front semi-circular cavity (6). A portion of the leg immediately behind the patella fits in area (12) and is supported by the transverse bar (3). The remainder of the concave cavity in the top of the pad shown as (13) is adapted to receive the upper part of the shin. The concave cavity is raised off the ground sufficiently so that the remainder of the leg does not contact the ground when the wearer is in the kneeling position. FIG. 2 is a transverse cross-section along the lines II—II of FIG. 1.

Figure 4:
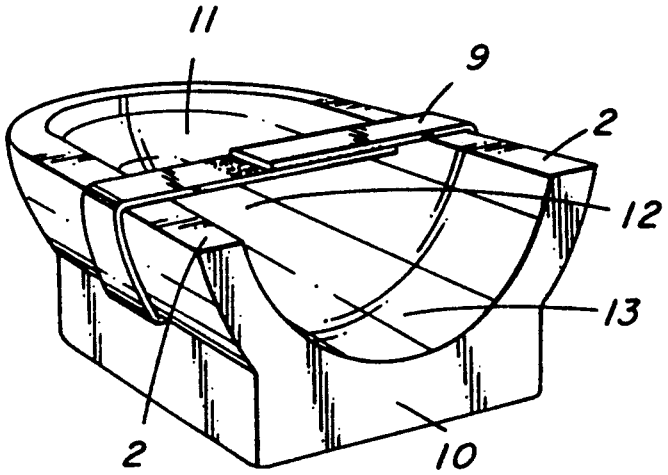
FIG. 4 is a perspective view of the knee pad.

FIG. 4 is a perspective view of the knee pad which is the subject of the invention showing the concave upper portions (11), (12) and (13) adapted to receive the knee cap and shin. The strap (9) which passes through the strap passageways (4) protrudes upwardly around the upper sidewalls (2) and is adapted to fasten about the calf of the wearer.

I claim as my invention is:

1. A knee protector pad adapted for use in an industrial workplace comprising a one-piece resilient, flexible polyurethane foam pad and an adjustable strap which is adapted to encircle the calf of the wearer and thereby fixedly secure the pad to the wearer's leg;

said pad including a concave upper portion with a rounded front end and an open, squared rear end;

said upper portion is adapted to receive the knee and upper portion of the shin of the wearer;

said pad further comprising a lower U-shaped sole with a rounded front and a squared back;

said sole having a lower surface facing away from said upper portion, a front semi-circular cavity and a rear rectangular cavity extending into said sole from said lower surface, said cavities separated by a transverse bar;

said front cavity being located immediately beneath the patella of the wearer when the pad is in an operating position and said transverse bar supports the portion of the shin of the wearer immediately behind said patella;

whereby said cavities are adapted to entrap air when the wearer is in the kneeling position with said lower surface in contact with a support surface thereby providing a cushioning effect.

2. A knee pad as claimed in claim 1, wherein said strap is positioned within said rear cavity such that when the pad is secured to the wearer, the portion of the strap encircling the wearer's calf is located below the leg crease between the upper and lower leg of the wearer.

* * * * *